United States Patent [19]

Daly et al.

[11] 4,017,069

[45] Apr. 12, 1977

[54] DIVING PLATFORM

[75] Inventors: Lewis J. Daly, Fayetteville; Alan W. Brownlie, Skaneateles, both of N.Y.

[73] Assignees: Robert C. Stevens, Pottsford; John M. Loftus, Scottsville, both of N.Y.

[22] Filed: Oct. 28, 1975

[21] Appl. No.: 626,297

[52] U.S. Cl. ..... 272/66; 273/DIG. 7

[51] Int. Cl.[2] ..... A63B 5/10

[58] Field of Search ..... 272/65, 66, 55; 273/DIG. 7

[56] References Cited

UNITED STATES PATENTS

| | | | |
|---|---|---|---|
| 122,546 | 1/1872 | Ziegler | 272/55 |
| 3,003,763 | 10/1961 | Griffith et al. | 272/66 |
| 3,083,965 | 4/1963 | Jewett | 272/66 |
| 3,166,315 | 1/1965 | Jewett | 272/66 |
| 3,321,204 | 5/1967 | Pretti | 272/66 |
| 3,795,397 | 3/1974 | Wilson | 272/66 |

*Primary Examiner*—Richard C. Pinkham
*Assistant Examiner*—William R. Browne
*Attorney, Agent, or Firm*—Bruns & Jenney

[57] ABSTRACT

A resilient platform for diving or jumping into a swimming pool where either the available deck space or the pool size prohibits use of a conventional diving board. The diving platform comprises in a compact, space-saving arrangement a base member fixed to the deck adjacent the pool edge, a board member pivotally connected at one end to the base member and a pair of arched spring arms that extend upwardly and outwardly from the base member to a point on the board that is spaced from its pivotal connection with the base. The outer ends of the spring arms carry an adjustable cross bar that passes beneath the board member to support its outer end.

8 Claims, 5 Drawing Figures

DIVING PLATFORM

BACKGROUND OF THE INVENTION

This invention relates generally to diving apparatus for swimming pools, and has particular reference to a novel diving platform that is specially adapted for use where either the available deck space or the pool size prohibits use of a conventional diving board.

In many above-ground and smaller in-ground swimming pools, a conventional 8 foot, 10 foot, or 12 foot diving board cannot be used either because the board is too long for the pool or because there is insufficient deck space to properly mount the board. As a result, various alternatives or substitutes have been developed in the form of platforms, short boards and spring treads. One of the latter is disclosed in U.S. Pat. No. 3,795,397 to J. C. Wilson, and is the closest prior art known to the applicant.

The Wilson spring tread in one form comprises a step and a tread, and in a second form a step and a short board. In both forms, the resiliency is obtained through coacting spring arms and spring bands. The Wilson spring tread is very compact and provides reasonably good spring. There has developed a need for a diving platform which is designed so that a diver can take a step or steps before bouncing on the resiliency supported tread as is normally desirable.

SUMMARY OF THE INVENTION

The diving platform of the present invention is a compact, space-saving assembly that has relatively good driving characteristics and response. In addition, the board is dimensioned so that a user can take at least one step prior to bouncing on the end of the board which is desirable as it usually helps the diver get more spring.

The diving platform to be disclosed comprises in its preferred form a base member adapted to be secured to the deck adjacent the pool edge, a molded board member pivotally connected at its inner end to the base member and a pair of arched spring arms that are secured to the base member and extend upwardly and outwardly therefrom. The spring arms terminate adjacent the outer part of the board member on opposite sides thereof and carry a cross bar that passes beneath the board to support its outer end. The position of the cross bar relative to the board member is adjustable so that the spring of the board can be varied.

DESCRIPTION OF THE PREFERRED EMBODIMENTS

Figure 1:
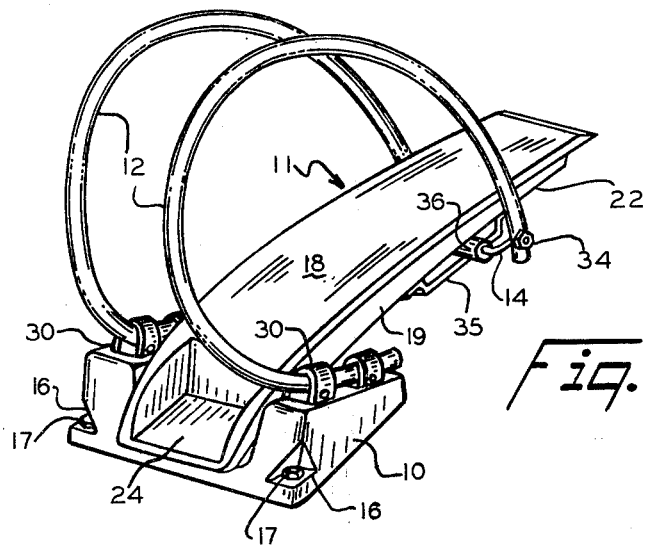
FIG. 1 is a top perspective view of a diving platform embodying the invention.
Figure 2:
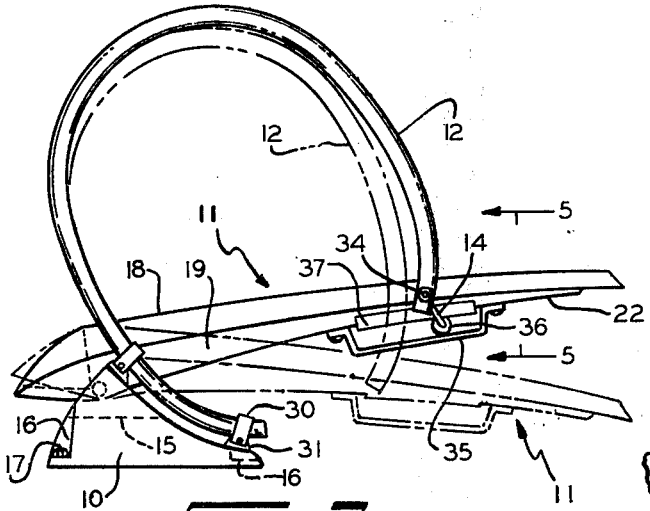
FIG. 2 is a side elevation of the diving platform, also showing the board member in depressed position in phantom lines.

Having reference now to the drawings, and with particular reference to FIGS. 1 and 2, the diving platform of the invention is essentially comprised of a base member 10 that is secured to the deck adjacent the edge of the pool, a board member 11 pivotally connected at its inner end to the base member, a pair of arched spring arms 12—12 that extend in a curving path from the base member to the outer part of the board and a cross bar 14 that is adjustably connected to the outer ends of the spring arms and passes beneath the board. The base member 10 can be a metal casting or molded fiber glass, and is generally saddle shaped having a central rectangular depression or recess 15, FIG. 4. Indentations 16 are formed adjacent the four corners of the base member, and the latter is bored at these indentations to receive bolts 17 which secure the base to a deck or other horizontal surface at the pool edge.

Figure 4:
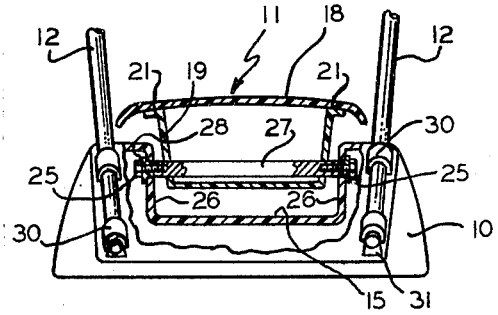
FIG. 4 is an elevation of the diving platform, looking from the right in FIG. 2, with parts broken away and in section to illustrate the pivotal connection between the board and the base members.

The board member 11 is preferably made of fiber glass and is of one or two piece construction with a generally flat top part 18 and a reinforcing under part 19 as best shown in FIG. 4. The two parts are securely bonded together along the upper edges 21 of the under part 19. Towards its outer end, the under part 19 of the board member may be bifurcated whereby it has two branches 22 at its outer end, FIG. 5, for greater stiffness. The upper surface of the top part 18 of the board has a non-skid surface as is customary, and is formed with a step 24, FIG. 1, at its inner end.

Board member 11 is pivotally connected to the base member 10 by bolts 25, FIG. 4, that pass through the side walls 26 of the base recess 15 and are threaded into a rod 27, the rod being embedded in the under part 19 of the board. Where the bolts pass through the walls 26, the latter are provided with sound absorbing bushings 28 in which the bolts can pivot freely.

Figure 5:
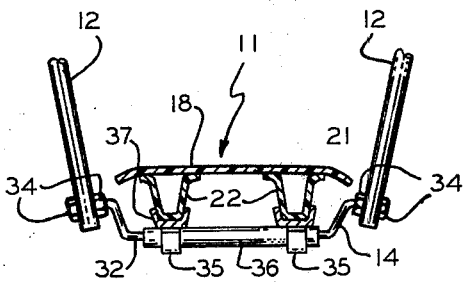
FIG. 5 is a vertical section through the outer part of the board member taken on line 5—5 of FIG. 2.

The outer part of the board member 11 is supported by a pair of arched spring arms 12—12, the inner ends of which are secured to the base member 10 as by clips 30 bolted to lugs 31 on the base as best shown in FIG. 2. At their outer, free ends the spring arms are connected by a cross bar 14 that passes beneath the board to resiliently support same. As best shown in FIG. 5, the central part 32 of the cross bar 14 is offset, and its threaded ends pass through bores in the spring arms and are secured to each arm as by a pair of nuts 34 and lock washers (not shown). A recoil limiting or anti-bounce strap 35 is secured to each branch 22 of the under part 19 of the board member so that the strap passes beneath the cross bar and restricts the distance that the board can bounce away from the bar during and after a dive.

In one form of the invention, the cross bar 14 is provided with a suitable roller 36, FIGS. 1, 2 and 5, to reduce wear between the bar and the branches 22 of the board member. In addition, the branches 22 can if desired be provided with low friction wear strips 37. In this connection, the board member 11 is shown in its depressed or under load position by phantom lines in FIG. 2; as the board moves from its undepressed to its depressed position, the outer ends of the spring arms 12—12 and the cross bar 14 move rearwardly relative to the board, with the cross bar being in sliding engagement with the branches 22 or their wear strips 37 during such movement.

Figure 3:
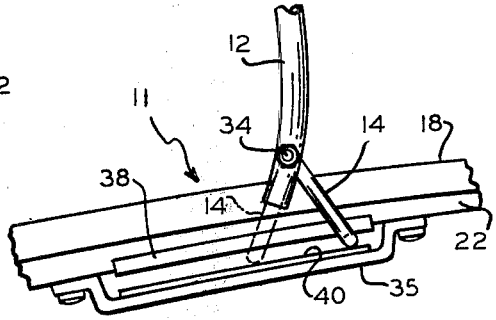
FIG. 3 is a fragmentary side elevation of the outer part of the board member showing a modified cross bar arrangement.

FIG. 3 illustrates another form of the invention wherein the cross bar 14 is employed without a roller, and in this case low friction wear strips 38 are required. In addition, strips of cushioning material 40 are bonded to the inner surfaces of the recoil limiting straps 35 to deaden recoil noise, these strips being unnecessary when a roller 36 having some resiliency is used. FIG. 3 illustrates in phantom lines the cross bar 14 after adjustment to its rearmost position to give the board its most limber response. Adjustment is made by loosening the four nuts 34, swinging the bar rearwardly and then tightening the nuts. Obviously, the bar can also be positioned anywhere in between the solid and phantom line positions shown. As will be apparent, the same adjustment can be made with the cross bar 14 and roller 36 of FIG. 2.

In a particlar embodiment of the invention, the spring arms 12—12 were formed of steel tubing with an outside diameter of 1½ inch and were bent so as to form the major portion of an ellipse as best shown in solid lines in FIG. 2. The major axis of the ellipse was 43 inches and the minor axis was 31 inches, and the major axis was tipped about 30° back from the vertical. This construction resulted in a board with good spring and otherwise desirable diving characteristics.

From the foregoing description it will be apparent that the invention provides a novel and very advantageous construction for a diving platform. As will be apparent to those familiar with the art, the invention may be embodied in other specific forms without departing from the spirit or essential characteristics thereof.

We claim:

1. A diving platform comprising a base member, a board member pivotally connected at one end to the base member, a pair of spring arms secured to the base member on opposite sides of the board member, the spring arms extending upwardly and outwardly from the base member and terminating adjacent a position on the board member that is spaced outwardly from its pivotal connection with the base member, and a cross bar connected to the outer, free ends of the spring arms and passing beneath the board member to support the outer end of same.

2. A diving platform as defined in claim 1 including recoil limiting straps mounted on the under side of the board member, the cross bar being positioned between the board member and straps.

3. A diving platform as defined in claim 1 including a roller amounted on the cross bar and normally engaging the under side of the board member.

4. A diving platform as defined in claim 1 wherein the position of the cross bar relative to the board member is adjustable.

5. A diving platform comprising a base member adapted to be fixed in position adjacent the edge of a swimming pool, an elongated molded board member pivotally connected at its inner end to the base member and extending outwardly therefrom over the water, a pair of bent tubular spring arms each of which is secured at one end of the base member, the spring arms extending upwardly and outwardly from the base member and terminating adjacent a position on the board member that is more than half the distance from the inner end of the board to the outer end thereof, and a cross bar adjustably connected to the outer, free ends of the spring arms and passing beneath the board member to support outer end of same.

6. A diving platform as defined in claim 5 including recoil limiting straps mounted on the under side of the board member, the cross bar being positioned between the board member and straps.

7. A diving platform as defined in claim 5 including a roller mounted on the cross bar and normally engaging the under side of the board member.

8. A diving platform as defined in claim 5 wherein the board member has a step formed in its inner end.

* * * * *